US005565971A

United States Patent [19]

Kuo et al.

[11] Patent Number: 5,565,971

[45] Date of Patent: Oct. 15, 1996

[54] PIVOTAL BI-DIRECTIONAL DECURLER

[75] Inventors: Youti Kuo, Penfield; James F. Smoak, Webster; Curtis Arline, Jr., Rochester, all of N.Y.

[73] Assignee: Xerox Corporation, Stamford, Conn.

[21] Appl. No.: 316,966

[22] Filed: Oct. 3, 1994

[51] Int. Cl.[6] ..... G03G 21/00

[52] U.S. Cl. ..... 355/309; 162/197; 162/271; 271/188; 271/209

[58] Field of Search ..... 355/309, 282, 355/207, 311; 271/161, 304, 184, 188, 209; 162/271, 197

[56] References Cited

U.S. PATENT DOCUMENTS

| | | | |
|---|---|---|---|
| 4,077,519 | 3/1978 | Huber | 271/193 X |
| 4,326,915 | 4/1982 | Mutschler, Jr. | 355/308 X |
| 4,360,356 | 11/1982 | Hall | 493/459 |
| 4,475,896 | 10/1984 | Bains | 493/454 |
| 4,589,650 | 5/1986 | Miyoshi | 271/188 X |
| 4,591,259 | 5/1986 | Kuo et al. | 271/188 X |
| 4,977,432 | 12/1990 | Coombs et al. | 355/309 |
| 5,066,984 | 11/1991 | Coombs | 355/309 |
| 5,414,503 | 5/1995 | Siegel et al. | 355/309 |

FOREIGN PATENT DOCUMENTS

| | | | |
|---|---|---|---|
| 1-267252 | 10/1989 | Japan | 271/209 |

*Primary Examiner*—Arthur T. Grimley
*Assistant Examiner*—Shuk Yin Lee
*Attorney, Agent, or Firm*—William A. Henry, II

[57] ABSTRACT

A pivotal, bi-directional decurler that changes sheet bending direction from an away from image to a toward image direction includes a decurler support structure that is mounted for bi-directional movement by a cam mechanism. A belt member is entrained around two support rollers that are supported by the decurler support structure with an unsupported span between the rollers. A pinch roll is adapted to form a nip with the unsupported span of the belt to provide away from image bending of copy sheets when the cam mechanism is rotated into a first position. An elastomer coated rotating shaft positioned downstream of the away from image nip cooperates with a bending baffle when the cam mechanism is rotated into a second position to provide toward image bending of copy sheets.

20 Claims, 2 Drawing Sheets

PIVOTAL BI-DIRECTIONAL DECURLER

BACKGROUND OF THE INVENTION

This invention relates generally to a printing unit or processor, such as, an office copier, facsimile or non-impact printer, and more particularly concerns an apparatus for decurling sheet material employed therein.

Generally, electrophotographic printing comprises charging a photoconductive member to a substantially uniform potential so as to sensitize the surface thereof. The charged portion of the photoconductive surface is exposed to a light image of the original document being reproduced. This records an electrostatic latent image on the photoconductive member which corresponds to the informational areas contained within the original document being reproduced. This records an electrostatic latent image on the photoconductive member which corresponds to the informational areas contained within the original document. The latent image is developed by bringing a developer material into contact therewith. In this way, a powder image is formed on the photoconductive member which is subsequently transferred to a sheet of support material. The sheet of support material is then heated to permanently affix the powder image thereto.

As the sheet of support material passes through the various processing stations in the electrophotographic printing machine, a curl or bend is frequently induced therein. Occasionally, this curl or bend may be inherent in the sheet of support material due to the method of manufacture thereof. It has been found that this curl is variable from sheet to sheet within the stack of sheets utilized in the printing machine. The curling of the sheet of support material causes problems of handling as the sheet is processed in the printing machine. Sheets delivered in a curled condition have a tendency to have their edges out of registration with the aligning mechanisms employed in the printing machine. In addition, curled sheets tend to produce jams or misfeeds within the printing machine. In the past, this problem has been resolved by utilizing bars, rollers or cylinders which engage the sheet material as it passes through the printing machine. Frequently, belts or soft rollers are used in conjunction with a hard penetrating roll to remove the curl in a sheet. However, systems of this type have disadvantages. For example, the size of the decurler is not necessarily consistent with that required in some electrophotographic printing machines. In addition, decurlers of this type generally have a high running torque necessitating significant power inputs to operate successfully. Moreover, on many occasions, in electrophotographic printing, devices previously employed smeared the powder image. Also, a conventional decurler, which most often is of the belt/pinch roll type, has a single paper path, although multiple bending can be set along the paper path, the single path is only effective in reducing paper curls that are primarily in one direction; it is not effective in reducing large curl in the other direction. In other words, if a conventional decurler is designed for flattening dominant TI (toward image) curls, it would not be able to reduce large AI (away from image) curls significantly, and vice versa. For this reason, a single path decurler would fail to decurl thin papers as they exhibit both strong AI and TI curls (depending on which side is on the hot fuser roll) at high moisture content.

Various approaches have been devised to improve sheet decurlers to answer the above-detailed problems. The following disclosures appear relevant:

U.S. Pat. No. 4,077,519; Patentee: Huber; issued Mar. 7, 1978.

U.S. Pat. No. 4,326,915; Patentee: Mutschler, Jr.; issued Apr. 27, 1982.

U.S. Pat. No. 4,360,356; Patentee: Hall; issued Nov. 23, 1982.

U.S. Pat. No. 4,475,896; Patentee: Bains; issued Oct. 9, 1984.

U.S. Pat. No. 4,977,432; Patentee: Coombs et al.; issued Dec. 11, 1990.

U.S. Pat. No. 5,066,984; Patentee: Coombs; issued Nov. 19, 1991.

The pertinent portions of the foregoing disclosures may be summarized as follows:

Huber describes a curl detector and separator wherein a paper sheet is passed through the nip of a rotating roll and charging roll, and thereafter the sheet is stripped from the rotating roll by a vacuum stripper which allows the sheet to pass between the nip of a subsequent transport roll pair.

Mutschler, Jr. discloses a sheet decurler apparatus wherein a sheet is pressed into contact with a rigid arcuate member in at least two regions. The sheet moves about the arcuate member or rod in a curved path to remove curl in the sheet. The sheet is bent in one direction by a first rod and in another direction by a second rod.

Hall discloses an apparatus for removing curl from continuous web material during its travel through engagement bars that can be adjusted to remove AI or TI curl.

Bains describes a curling/decurling mechanism that combines a compliant roller with a soft outer layer in a curling roller to form a penetration nip with the compliant roller. Movable parts are employed to control the angle of sheets as they exit from the nip.

Coombs et al. is directed to a decurling device that includes an arcuate concave guide and a feed roll which causes paper to pass between the guide and the feed roll to decurl the paper. A means is included for selectively laterally offsetting paper driven through the device.

Coombs describes a decurling device that includes an arcuate concave guide and a feed roll which causes paper to pass between the guide and the feed roll to decurl the paper. The space between the guide and the roll is greater than the thickness of the paper and the paper is bent in the direction opposite to its curl as it passes through the arched space.

The present invention aims at providing a rotational decurler designed with the capability of bending sheets in both toward image (TI) and away from image (AI) directions. The bending level in either direction can be adjusted automatically to flatten different levels of incoming sheet curl with different properties.

SUMMARY OF THE INVENTION

Accordingly, the present invention provides a pivotable, bi-directional decurler that changes sheet bending direction from AI to TI direction by a rotational means. The pivotable, bi-directional decurler includes a decurler support structure that is mounted for bi-directional movement by means of a cam mechanism. A belt member is entrained around two support rollers that are supported by the decurler support structure with an unsupported span between the rollers. A pinch roll is adapted to form a nip with the unsupported span of the belt to provide AI bending of copy sheets when the cam mechanism is pivoted into a first position. An elastomer coated rotating shaft positioned downstream of the AI nip cooperates with a bending baffle when the cam mechanism is pivoted into a second position to provide TI bending of copy sheets.

BRIEF DESCRIPTION OF THE DRAWINGS

The foregoing and other features of the present invention will be apparent from a further reading of the specification, claims and from the drawings in which:

While the present invention will be described hereinafter in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

The invention will now be described by reference to a preferred embodiment of the decurler system of the present invention preferably for use in a conventional copier/printer. However, it should be understood that the sheet decurling method and apparatus of the present invention could be used with any machine environment in which decurling of sheets is desired.

In general, an improvement to prior sheet decurling systems of machines is disclosed which is cost effective and comprises the use of a pivotable decurler with the capability of bending sheets in both directions (AI and TI) with equal latitude using a cam mechanism.

Figure 2:
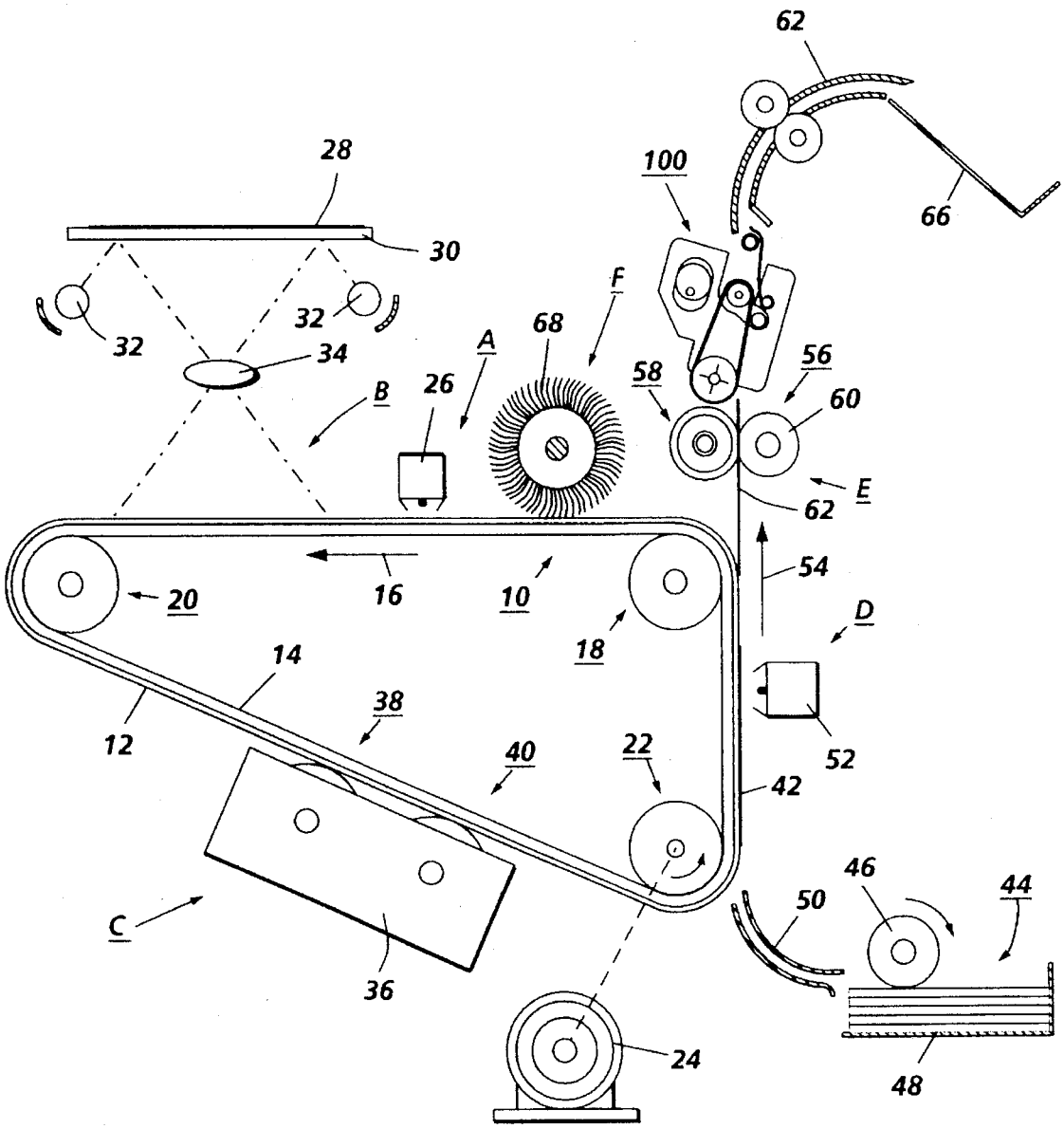
FIG. 2 is an elevational view illustrating schematically an electrophotographic printing machine incorporating the decurler of FIGS. 1A and 1B therein.

For a general understanding of the features of the present invention, reference is made to the drawings. In the drawings like reference numerals have been used throughout to designate identical elements. FIG. 2 schematically depicts the various components of an illustrative electrophotographic printing machine incorporating the decurling apparatus of the present invention therein. It will become evident from the following discussion that the decurling apparatus is equally well suited for use in a wide variety of printing machines and is not necessarily limited in its application to the particular embodiment shown herein. In addition, the location of the decurling apparatus, as depicted in the FIG. 2 electrophotographic printing machine, may be varied. The decurling apparatus may be positioned intermediate any of the processing stations within the printing machine. In the printing machine, depicted in FIG. 2, the decurling apparatus is positioned after the fusing station prior to the catch tray so as to straighten the final copy sheet prior to removal from the printing machine by the operator. However, this location is merely illustrative of the operation of the decurling apparatus and mall be varied.

Inasmuch as the art of electrophotographic printing is well known, the various processing stations employed in the FIG. 2 printing machine will be shown hereinafter schematically and their operation described briefly with reference thereto.

As shown in FIG. 2, the electrophotographic printing machine employs a belt 10 having a photoconductive surface 12 deposited on a conductive substrate 14. Preferably, photoconductive surface 12 comprises a transport layer having small molecules of m-TBD dispersed in a polycarbonate and a generation layer of trigonal selenium. Conductive substrate 14 is made preferably from aluminized polyester film, such as, Mylar which is electrically grounded. Belt 10 moves in the direction of arrow 16 to advance successive portions of photoconductive surface 12 through the various processing station disposed about the path of movement thereof. Belt 10 is entrained about stripping roller 18, tension roller 20, and drive roller 22. Drive roller 22 is mounted rotatably and in engagement with belt 10. Roller 22 is coupled to motor 24 by suitable means such as belt drive. Motor 24 rotates roller 22 to advance belt 10 in the direction of arrow 16. Drive roller 22 includes a pair of opposed, spaced edge guides. The edge guides define a space therebetween which determines the desired path of movement of belt 10. Belt 10 is maintained in tension by a pair of springs (not shown) resiliently urging tension roller 20 against belt 10 with the desired spring force. Both stripping roller 18 and tension roller 20 are mounted to rotate freely.

With continued reference to FIG. 2, initially a portion of belt 10 passes through charging station A. At charging station A, a corona generating device, indicated generally by the reference numeral 26, charges photoconductive surface 12 to a relatively high, substantially uniform potential.

Thereafter, the charged portion of the photoconductive surface 12 is advanced through exposure station B. At exposure station B, an original document 28 is positioned face-down upon transparent platen 30. Lamps 32 flash light rays onto original document 28. The light rays reflected from original document 28 are transmitted through lens 34 forming a light image thereof. Lens 34 focuses the light image onto the charged portion of photoconductive surface 12 to selectively dissipate the charge thereon. This records an electrostatic latent image on photoconductive surface 12 which corresponds to the informational areas contained within original document 28.

Next, belt 10 advances the electrostatic latent image recorded on photoconductive surface 12 to development station C. At development station C, a magnetic brush development system, indicated generally by the reference numeral 36, transports a developer material into contact with photoconductive surface 12. Preferably, the developer material comprises carrier granules having toner particles adhering triboelectrically thereto. Magnetic brush system 36 preferably includes two magnetic brush developer rollers 38 and 40. These developer rollers each advance the developer material into contact with the photoconductive surface 12. Each developer roller forms a chain-like array of developer material extending outwardly therefrom. The toner particles are attracted from the carrier granules to the electrostatic latent image forming a toner powder image in photoconductive surface 12 of belt 10.

Belt 10 then advances the toner powder image to transfer station D. At transfer station D, a sheet of support material 42 is moved into contact with the toner powder image. The sheet of support material is advanced to transfer station D by a sheet feeding apparatus 44. Preferably, a sheet feeding apparatus 44 includes a feed roll 46 contacting the uppermost sheet of stack 48. Feed roll 46 rotates to advance the uppermost sheet from stack 48 into chute 50. Chute 50 directs the advancing sheet of support material into contact with photoconductive surface 12 in registration with the toner powder image developed thereon. In this way, the toner powder image contacts the advancing sheet of support material at transfer station D.

Transfer station D includes a corona generating device 52 which sprays ions onto the backside of sheet 42. This attracts the toner powder image from photoconductive surface 12 to sheet 42. After transfer, the sheet continues to move in the direction of arrow 54 onto a conveyor (not shown) which advances the sheet to fusing station E.

Fusing station E includes a fuser assembly, indicated generally by the reference numeral 56, which permanently affixes the transferred toner powder image to sheet 42. Preferably, a fuser assembly 56 includes a heated fuser roller 58 and a back-up roller 60. Sheet 42 passes between fuser roller 58 and a back-up roller 60 with the toner powder image contacting fuser roller 58. In this manner, the toner powder image is heated so as to be permanently affixed to sheet 42. After fusing, sheet 62 guides advancing sheet 42 to the decurling apparatus, indicated generally by the reference numeral 100. At this time, the sheet of support material has undergone numerous processes and very frequently contains undesired curls therein. This may be due to the various processes through which it has been subjected, or to the inherent mature of the sheet material itself. Decurling apparatus 100 bends the sheet of support material so that the sheet material is strained to exhibit plastic characteristics. After passing through decurling apparatus 100, the sheet of support material is advanced into catch tray 66 for subsequent removal from the printing machine by the operator. The detailed structure of decurling apparatus 100 will be described hereinafter with reference to FIGS. 1A and 1B.

After the sheet of support material is separated from photoconductive surface 12 of belt 10, some residual particles remain adhering thereto. These residual particles are removed from photoconductive surface 12 at cleaning station F. Cleaning station F includes a pre-clean corona generating device (not shown) and a rotatably mounted fibrous brush 68 in contact with photoconductive surface 12. The pre-clean corona generating device neutralizes the charge attracting the particles to the photoconductive surface. The particles are then cleaned from photoconductive surface 12 by the rotation of brush 68 in contact therewith. Subsequent to cleaning, a discharge lamp (not shown) floods photoconductive surface 12 with light to dissipate any residual electrostatic charge remaining thereon prior to the charging thereof for the next successive image cycle.

Figure 1A:
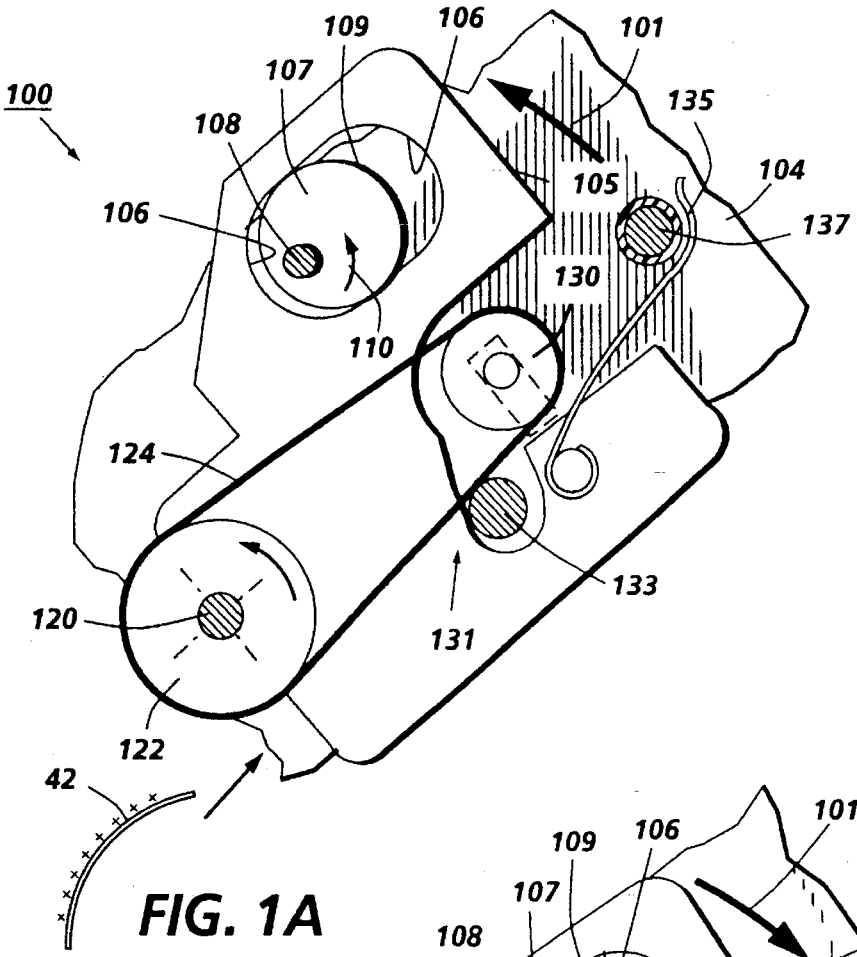
FIG. 1A is an elevational view showing the decurling apparatus of the present invention in a toward image bending position.
Figure 1B:
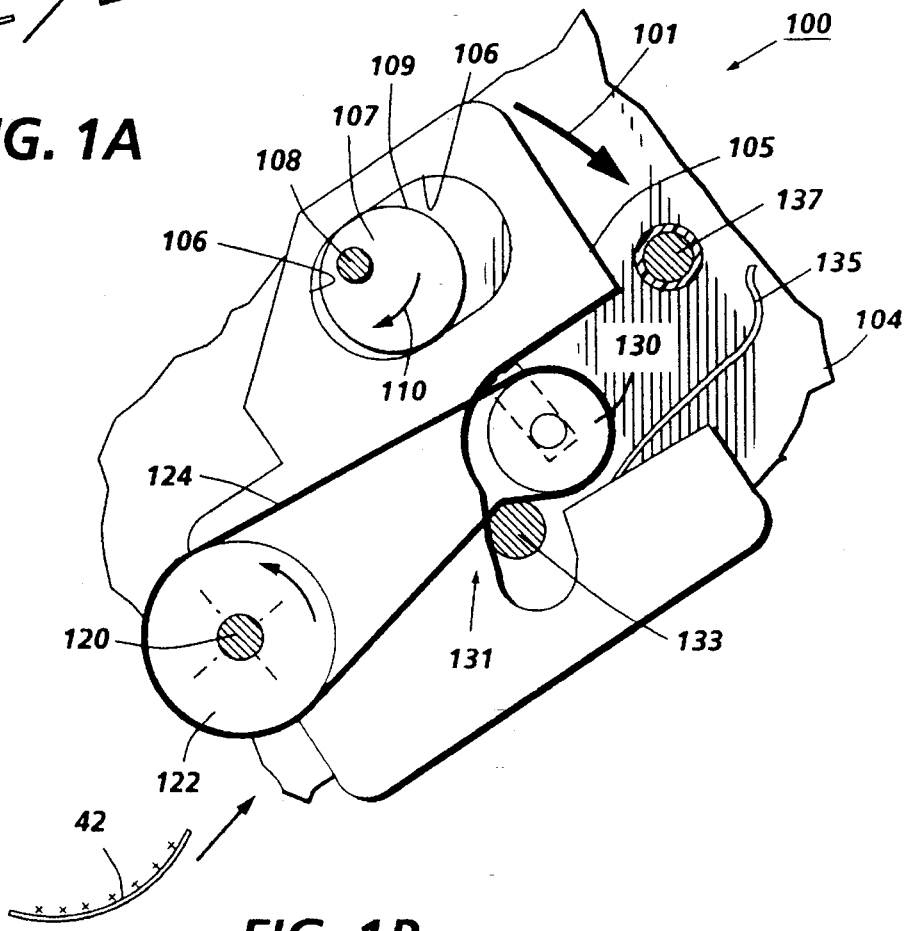
FIG. 1B is an elevational view showing the decurling apparatus of the present invention after it has been pivoted by a cam mechanism to an away from image bending position.

Referring now to the subject matter of the present invention, FIGS. 1A and 1B depict an embodiment 100 of the decurler apparatus of the present invention in detail. The decurling apparatus 100 features a housing 105 supported by a machine frame 104 for bidirectional pivotal or rotational movement in the directions of arrow 101 by manipulation of a cam mechanism that includes an oblong shaped cam slot 106 cut out of housing 105 and a cam 106 connected to a rotatable cam shaft 108 that is supported by the frame of the machine for bi-directional pivoting as indicated by arrow 110. Pivoting of cam 107 moves housing 105 in the directions indicated by arrow 101. A belt assembly pivots with housing 105 and includes roller 130 mounted for movement with housing 105 in a clockwise and counter clockwise direction and a belt 124 entrained around roller 130 and rotatable and non-pivotable roller 122 that is mounted on shaft 120. A pinch roll or idler shaft 133 is supported by the machine frame and adapted to form a nip with belt 124 when the decurler is pivoted in a clockwise direction to a first (away from image) bending position. A one-side imaged (simplexed) sheet entering the nip at the sheet entrance point 131 will have toward image curl taken out of it.

A bending baffle 135 is included with decurler 100 and is adapted to pivot with housing 105 in a second, counter clockwise direction to form a nip with elastomer coated rotating shaft 137 and accommodate sheets to place (toward image) curl in the sheets. Toward image is used herein to connote toward the first side image of a sheet. Away from image is used herein to mean bending a sheet away from the first side image thereon. Bi-directional decurler 100 has the the capability of bending sheets in both directions (AI and TI) with equal capacity with manipulation of cam 107 and can selectively provide reverse bending to a fused sheet which can be curled in either direction after leaving the fuser depending on the image area coverage of the particular sheet. However, in general, fused plain sheets or lightly imaged copy sheets may have AI curl while a fully imaged copy sheet may have TI curl. To reduce the curl, TI bending is applied to the AI curl and AI bending is applied to TI curl. These TI and AI bendings are made possible by rotating cam 107 which in turn moves housing 105 and the belt assembly. Cam 107 rotates the belt assembly while the idler shaft 133 is stationary, therefore, as the cam rotates it causes the belt 124 to penetrate into the idle shaft 133. The bending power of the decurler is directly proportional to penetration, that is, as the penetration is increased so is the bending power. FIGS. 1A and 1B show the minimum and maximum settings of the bi-directional decurler as paper or sheets passes through the system with FIG. 1B showing the AI bending position and FIG. 1A showing the TI bending position. In the FIG. 1B position of the decurler which is for more penetration for AI bending, a sheet exits without being effected by the rotating shaft 137 at the end of the housing 105. When the decurler is in the FIG. 1A position there is minimal AI penetration at the idler shaft 133, but a sheet is being bent in the TI direction by rotating shaft 137 in conjunction with the positioning of bending baffle 135.

It is, therefore, evident that there has been provided in accordance with the present invention a bi-directional decurler apparatus for copiers/printers or the like which serves to reverse bend or decurl a sheet at process speed thereby fully satisfying the aims and advantages hereinbefore set forth. The reverse bending is accomplished with a rotational decurler which has the capability of bending sheets in both directions, i.e., toward an image or away from the image (AI and TI), with equal latitude using a cam mechanism. The bending level in either direction can be adjusted automatically to flatten different levels of incoming sheet curl with different properties. These different levels of bends (AI and TI) are producible by the cam rotating the belt assembly to a point where it cooperates with a pinch roll to form a nip for bending sheets in a first direction. A second pinch roll is provided that engages with a bending baffle to provide decurling in a second and opposite direction.

While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. A bi-directional decurling device for removing curl from sheets en route to exiting a printing machine, comprising: a bi-directionally pivotable housing including an oblong opening therein; an endless, bi-directional moveable belt entrained around a spaced apart first shaft and idler roll; a pinch roll that cooperates with said endless belt to form a nip to provide away from image bending of sheets passing therethrough when said housing has been pivoted toward said pinch roll in a first direction into a first position; a second shaft; a sheet bending baffle connected to said housing for bi-directional pivotal movement with said housing such that pivotal movement of said housing in a second direction opposite to said first direction causes said sheet bending baffle to cooperate with said second shaft to provide toward image bending of sheets; and a pivotable cam positioned within said oblong opening in said housing, and wherein rotation of said pivotable cam in said first or second directions moves said housing in said first or second directions.

2. The bi-directional decurling device of claim 1, wherein said second shaft is elastomer coated.

3. The bi-directional decurling device of claim 2, wherein said elastomer coated second shaft is stationary with respect to movement in said first and second directions.

4. The bi-directional decurling device of claim 3, wherein said sheet bending baffle will not decurl sheets when said housing is moved in said first direction.

5. The bi-directional decurling device of claim 4, wherein said cam is circular in cross-section and eccentrically mounted on a rotatable shaft.

6. The bi-directional decurling device of claim 5, wherein said nip formed between said endless belt and said pinch roll provides a drive force for the sheet to move into a nip formed by said bending baffle and said second shaft.

7. A pivotable bi-directional decurler that changes copy sheet bending direction from away from image to toward image direction, comprising: a decurler support structure that is mounted for bi-directional movement; a cam mechanism for bi-directionally pivoting said support structure; a belt member entrained around two support rollers that are supported by said decurler support structure with an unsupported span between said rollers; a pinch roll that forms a nip with said unsupported span of said belt member to provide away from image bending of copy sheets when said cam mechanism is pivoted in a first direction; a copy sheet bending baffle connected to said decurler support structure; and a shaft supported by said support structure in a position removed from said away from image sheet bending nip so as to cooperate with said copy sheet bending baffle when said cam mechanism is pivoted in a second direction to provide toward image bending of copy sheets.

8. The bi-directional decurler of claim 7, wherein said shaft is elastomer coated.

9. The bi-directional decurler of claim 8, wherein said elastomer coated shaft is stationary with respect to said bi-directional movement of said decurler support structure.

10. The bi-directional decurler of claim 9, wherein said copy sheet bending baffle will not decurl sheets when said decurler support structure is moved in said first direction.

11. The bi-directional decurler of claim 10, wherein said cam mechanism includes a cam member that is circular in cross-section and eccentrically mounted on a rotatable shaft.

12. The bi-directional decurler of claim 10, wherein said decurler support structure includes a slot therein and wherein a cam member of said cam mechanism is positioned for pivotal movement within said slot.

13. A printer that prints page image information onto copy sheets including a pivoting, bi-directional decurler that changes copy sheet bending direction from an away from image to a toward image direction, comprising: a decurler support structure that is mounted for bi-directional movement; a cam mechanism for bi-directionally pivoting said support structure; a belt member entrained around two support rollers that are supported by said decurler support structure with an unsupported span between said rollers; a pinch roll that forms a nip with said unsupported span of said belt member to provide away from image bending of copy sheets when said cam mechanism is rotated in a first direction; a copy sheet bending baffle connected to said decurler support structure; and a shaft supported by said support structure in a position removed from said away from image sheet bending nip so as to cooperate with said copy sheet bending baffle when said cam mechanism is pivoted in a second direction to provide toward image bending of copy sheets.

14. The printer of claim 13, wherein said shaft is elastomer coated.

15. The printer of claim 14, wherein said elastomer coated shaft is stationary with respect to said bi-directional movement of said decurler support structure.

16. The printer of claim 15, wherein said copy sheet bending baffle will not decurl sheets when said decurler support structure is moved in said first direction.

17. The printer of claim 16, wherein said cam mechanism includes a cam member that is circular in cross-section and eccentrically mounted on a rotatable shaft.

18. The printer of claim 17, wherein said decurler support structure includes a slot therein and wherein said cam member of said cam mechanism is positioned for rotational movement within said slot.

19. The method of decurling sheets of paper exiting from a printing machine or the like, comprising the steps of:

decurling away from image curl in sheets in a nip formed between opposed surfaces of a belt and a pinch roll while moving the sheets through said nip; and decurling toward image curl in sheets opening said nip and decurling the sheets in nip formed between a shaft and a bending baffle, and providing said shaft with an elastomer coating.

20. The method of claim 19, including the step of feeding the sheets in a predetermined direction and positioning said shaft and said bending baffle downstream of said belt and pinch roll.

* * * * *